US009934952B2

(12) United States Patent
Hayashi

(10) Patent No.: US 9,934,952 B2
(45) Date of Patent: Apr. 3, 2018

(54) CHARGED-PARTICLE DETECTOR AND METHOD OF CONTROLLING THE SAME

(71) Applicant: HAMAMATSU PHOTONICS K.K., Hamamatsu-shi, Shizuoka (JP)

(72) Inventor: Masahiro Hayashi, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 15/232,066

(22) Filed: Aug. 9, 2016

(65) Prior Publication Data

US 2017/0047213 A1 Feb. 16, 2017

(30) Foreign Application Priority Data

Aug. 10, 2015 (JP) ..... 2015-158293

(51) Int. Cl.
*H01J 49/02* (2006.01)
*H01J 49/26* (2006.01)
*H01J 43/24* (2006.01)

(52) U.S. Cl.
CPC ..... *H01J 49/025* (2013.01); *H01J 43/246* (2013.01)

(58) Field of Classification Search
CPC ..... H01J 49/26; H01J 49/025; H01J 43/246
USPC .... 250/396 R, 397, 306, 307, 309, 310, 311, 250/281, 492.3
See application file for complete search history.

(56) References Cited

U.S. PATENT DOCUMENTS

| | | | | |
|---|---|---|---|---|
| 4,568,853 | A | 2/1986 | Boutot | |
| 6,236,053 | B1 | 5/2001 | Shariv | |
| 7,564,043 | B2 * | 7/2009 | Hayashi | H01J 43/246 250/287 |
| 8,471,444 | B2 | 6/2013 | Van Spijker | |
| 2014/0097340 | A1 * | 4/2014 | Suzuki | G01T 1/00 250/287 |
| 2016/0217972 | A1 * | 7/2016 | Hayashi | H01J 37/28 |
| 2016/0217995 | A1 * | 7/2016 | Hayashi | H01J 49/025 |

FOREIGN PATENT DOCUMENTS

| | | |
|---|---|---|
| EP | 2634790 A2 | 9/2013 |
| JP | S57-196466 A | 12/1982 |

* cited by examiner

*Primary Examiner* — Nicole Ippolito
(74) *Attorney, Agent, or Firm* — Drinker Biddle & Reath LLP

(57) ABSTRACT

The present embodiment relates to a charged-particle detector, etc. provided with a structure for effectively suppressing ion feedbacks under a low-vacuum environment. In order to capture the residual-gas ions, which are generated by collisions between the electrons output from a MCP unit 200 and residual-gas molecules, by a second electrode 400, which is electrically insulated from a first electrode 300, which is mainly for capturing electrons, the potential of the first electrode 300 is set to be higher than an output-side potential of the MCP unit 200, and, on the other hand, the potential of the second electrode 400 is set to be lower than the output-side potential of the MCP unit 200. As a result, the ion feedbacks to the MCP unit 200 are effectively suppressed.

7 Claims, 8 Drawing Sheets

CHARGED-PARTICLE DETECTOR AND METHOD OF CONTROLLING THE SAME

TECHNICAL FIELD

The present invention relates to a charged-particle detector including a MCP unit including a plurality of microchannel plates (hereinafter, described as MCPs) and to a method of controlling the same.

BACKGROUND

As a detector that enables high-sensitivity detection of charged particles such as ions and electrons, for example, a charged-particle detector provided with a multiplier means such as MCP for obtaining a certain gain is known. The charged-particle detector like this is generally installed as measurement equipment in a vacuum chamber of, for example, a mass analyzer.

FIG. 1A shows a rough configuration of a residual gas analyzer (RGA: Residual Gas Analyzer) as an example of the mass analyzer. In the residual gas analyzer 1, as shown in FIG. 1A, an ion source 10, converging lenses 20, a mass analyzing part 30, and a measuring part 100 are disposed in a vacuum chamber, which is maintained at a certain vacuum degree.

In the residual gas analyzer 1, a residual gas introduced to the ion source 10 is ionized when the gas collides with thermal electrons emitted from high-temperature filaments. The ions generated in the ion source 10 in this manner are accelerated and converged when the ions pass through the converging lenses 20 including a plurality of electrodes, and, at the same time, the ions are guided to the mass analyzing part 30. The mass analyzing part 30 sorts the ions which have mutually different masses by applying direct-current voltages and alternating-current voltages to four cylindrical electrodes (quadruple). More specifically, the mass analyzing part 30 can change the voltages applied to the four cylindrical electrodes and, as a result, cause the ions having the mass-to-charge ratios corresponding to the values thereof to selectively pass therethrough. The measuring part 100 detects, as a signal (ion current), the ions which have passed through the mass analyzing part 30 among the ions introduced to the mass analyzing part 30 in the above described manner. The ion current is proportional to the amount (partial pressure) of the residual gas.

As the measuring part 100, for example, a charged-particle detector 100A provided with a MCP unit 200 for obtaining a certain gain as shown in FIG. 1B can be applied. Note that the MCP unit 200 has an input surface 200*a* and an output surface 200*b* and includes two MCPs 210 and 220 disposed in a state in which the MCPs are stacked in the space between the input surface 200*a* and the output surface 200*b*. The charged-particle detector 100A is provided with the MCP unit 200 for obtaining such a desired gain and an anode electrode 240 for capturing the electrons emitted from the output surface 200*b* of the MCP unit 200. Note that voltages (each of which is a negative voltage) having mutually different values are applied from a voltage control circuit (bleeder circuit) 230 to the input surface 200*a* and the output surface 200*b* of the MCP unit 200, respectively, so that the potential of the output surface 200*b* becomes higher than the potential of the input surface 200*a*. On the other hand, the anode electrode 240 is set to a ground potential (0 V), and the electrons, which are captured by the anode electrode 240 and from the MCP unit 200, are input to an amplifier 250 as an electric signal. Then, the electric signal (amplified signal) amplified by the amplifier 250 is detected from an output end OUT.

SUMMARY

The inventor studied conventional charged-particle detectors and found problems as below. That is, a Time-of-Flight mass spectrometer (TOF-MS) or the like which improves performance when an ion flight distance becomes long among mass analyzers requires measurement in a high-vacuum state of about $10^{-4}$ Pa (about $10^{-6}$ Torr). On the other hand, in order to simplify a vacuum exhaust mechanism (reduce manufacturing cost), shorten the mean free path of ions (apparatus downsizing), and so on, demands for developing charged-particle detectors capable of carrying out high-sensitivity mass analyses in a low-vacuum state of about $10^{-1}$ Pa (about ($10^{-3}$ Torr) are increasing. Particularly, high-sensitivity (low-noise) ion detection with a gain of about $10^5$ under a low-vacuum environment of about $10^{-1}$ Pa (about $10^{-3}$ Torr), is desired.

However, the more the vacuum degree is reduced, the more the residual-gas molecules in a chamber are increased. Therefore, in the mass analysis under a low-vacuum environment, increase of dark noise caused by ionization (electron ionization) of the unnecessary residual-gas molecules is problematic. Specifically, as shown in FIG. 1B, it is conceivably caused by generation of residual-gas ions by collisions between the electrons emitted from the MCP unit 200 and the residual-gas molecules present between the electrodes. Note that this electron ionization is known to maximize ionization efficiency by the collisions of the electrons of 70 to 100 eV (output electron energy of MCP is 80 to 100 eV), and most of the residual-gas ions generated by the electron ionization are positive ions (positively-charged particles) ((element M)+($e^-$)→($M^+$)+2($e^-$)).

In the electrode arrangement of FIG. 1B, since the potential of the anode electrode 240 is set to be higher than the output-side potential of the MCP unit 200, the unnecessary positive ions ($M^+$) generated between the electrodes move directly toward the output surface 200*b* of the MCP unit 200 (path shown by an arrow A in FIG. 1B) or float around the charged-particle detector 100A and then reach the incident surface 200*a* of the MCP unit 200 (path shown by an arrow B in FIG. 1B). In this manner, when a phenomenon in which the positive ions generated between the electrodes in the charged-particle detector 100A reach the MCP unit 200, in other words, an ion feedback occurs, the electrons derived from the residual gas are detected as dark noise. Therefore, high-sensitivity detection of charged particles under a low-vacuum-degree environment becomes difficult.

Note that U.S. Pat. No. 8,471,444 (Patent Literature 1) discloses formation of an ion barrier film for shielding stray ions. Meanwhile, Japanese Patent Application Laid-Open No. S57-196466 (Patent Literature 2) shows a structure in which an anode 20 is sandwiched by MCP(s) 12 to 14, 25, or 31 to 32 and a flat-plate dynode 19. In such an electrode arrangement of Patent Literature 2, the potential of the flat-plate dynode 19 is set to be lower than the potential of the anode 20, and the potential of the MCP(s) is set to be further lower than the potential of the flat-plate dynode 19. It is difficult also for such an electrode arrangement to avoid the ion feedback caused by the electron ionization between the electrodes.

The present invention has been accomplished to solve the above described problems, and it is an object of the present invention to provide a charged-particle detector provided with a structure for effectively suppressing the feedback phenomenon (ion feedback) of the positively-charged particles, which are generated by electron ionization under a low-vacuum environment, toward an electron-multiplying-structure (MCP) side and to provide a method of controlling the same.

A charged-particle detector according to the present embodiment is provided with a MCP unit for realizing an electron multiplying function and is provided with a structure for enabling precise detection of charged particles such as ions under a low-vacuum-degree environment of about $10^{-1}$ Pa (=$10^{-3}$ Torr). More specifically, the charged-particle detector is provided with the structure for efficiently removing residual-gas ions (cause of ion feedbacks), which are generated when the electrons emitted from the MCP unit collide with residual-gas molecules between electrodes.

As a first aspect of the present embodiment, the charged-particle detector has a structure for separately capturing charged particles, which are present in output-surface-side space of the MCP unit, in a manner sorted to negatively-charged particles such as secondary electrons emitted from the MCP unit and positively-charged particles such as residual-gas ions generated by electron ionization. Specifically, the charged-particle detector is provided with, at least, the MCP unit, a MCP input-side electrode, a MCP output-side electrode, a first electrode mainly for capturing electrons (negatively-charged particles) from the MCP unit as signals, and a second electrode for capturing the residual-gas ions (unnecessary positively-charged particles). The MCP unit has an input surface and an output surface opposed to the input surface. Moreover, the MCP unit includes one or more MCPs (microchannel plate(s)) disposed in the space between the input surface and the output surface. The MCP input-side electrode is an electrode disposed in a state in which at least part thereof is in contact with the input surface of the MCP unit, and the MCP input-side electrode has an opening for exposing the input surface of the MCP unit. The MCP output-side electrode is an electrode disposed in a state in which at least part thereof is in contact with the output surface of the MCP unit. Moreover, the MCP output-side electrode has an opening for exposing the output surface of the MCP unit and is configured to be set to a potential higher than that of the MCP input-side electrode.

Particularly, in this first aspect, the first electrode is disposed so as to sandwich the MCP output-side electrode together with the MCP input-side electrode. Moreover, the second electrode is disposed so as to sandwich the first electrode together with the MCP output-side electrode. Furthermore, the first electrode has one or more opening(s) and is configured to be set to a potential higher than that of the MCP output-side electrode. Moreover, the second electrode is configured so as to be set to a potential lower than that of the MCP output-side electrode.

As a second aspect applicable to the above described first aspect, the first electrode is preferred to have: a first principal surface facing the MCP output-side electrode; a second principal surface facing the second electrode; a through hole communicating the first principal surface and the second principal surface to each other; and a mesh-shaped or lattice-shaped wire electrode portion disposed so as to block an opening of the through hole, and the wire electrode portion defining the plurality of openings.

As a third aspect applicable to at least any of the aspects among the first and second aspects, the charged-particle detector is preferred to be provided with a potential setting structure for electrically connecting the second electrode and the MCP input-side electrode to each other. In this case, the potential of the second electrode and the potential of the MCP input-side electrode match each other. However, the potential of the second electrode may be lower than the potential of the MCP input-side electrode. Note that, as a fourth aspect applicable to at least any of the aspects among the first to third aspects, the MCP input-side electrode may be provided with a flange portion. This flange portion functions as the above described potential setting structure and also functions as part of a body housing other electrodes other than the MCP unit. Specifically, the flange portion has a shape extending from the MCP input-side electrode toward the second electrode in a state in which the MCP unit, the MCP output-side electrode, and the first electrode are surrounded, and the flange portion directly contacts the second electrode.

As a fifth aspect applicable to at least any of the aspects among the first and fourth aspects, the charged-particle detector may be further provided with a voltage control circuit for individually setting the potentials of the first electrode and the second electrode. In this case, the voltage control circuit can cause the potentials of the electrodes to be different from each other by applying voltages of mutually different values to the first electrode and the second electrode, respectively.

A controlling method according to the present embodiment controls detection operations of a charged-particle detector having the structure as described above, in other words, the charged-particle detector according to at least any of the above described first to fifth aspects. Specifically, in the controlling method, a voltage higher than the voltage applied to the MCP output-side electrode is applied to the first electrode. On the other hand, a voltage lower than the voltage applied to the MCP output-side electrode is applied to the second electrode. When the voltages having mutually different values are respectively applied to the first electrode and the second electrode in this manner, a potential gradient in which the first electrode is positioned at a peak is formed in the space defined between the MCP output-side electrode and the second electrode.

As an aspect applicable to the above described controlling method, mutually equal voltages may be applied to the MCP input-side electrode and the second electrode, respectively. In this case, the MCP input-side electrode and the second electrode are set to the same potential, and the structure of the charged-particle detector per se can be simplified.

Note that embodiments according to the present invention will be more sufficiently understood by the following detailed descriptions and attached drawings. These embodiments are shown merely as examples and should not be construed to limit the present invention.

Moreover, further application ranges of the present invention will be elucidated by the following detailed descriptions. However, the detailed descriptions and particular cases show preferred embodiments of the present invention, but are shown only as examples, and it is obvious that various modifications and improvements in the scope of the present invention are obvious to those skilled to the art from the detailed descriptions.

DETAILED DESCRIPTION

Hereinafter, embodiments of a charged-particle detector and a method of controlling the same according to the present invention will be described in detail with reference to the attached drawings. Note that the same elements in the description of the drawings are denoted by the same reference signs, and redundant descriptions will be omitted. Moreover, the present embodiments are not limited to these examples, but are represented by claims, and are intended to include all modifications within the equivalent meanings and ranges as claims.

Figure 2:
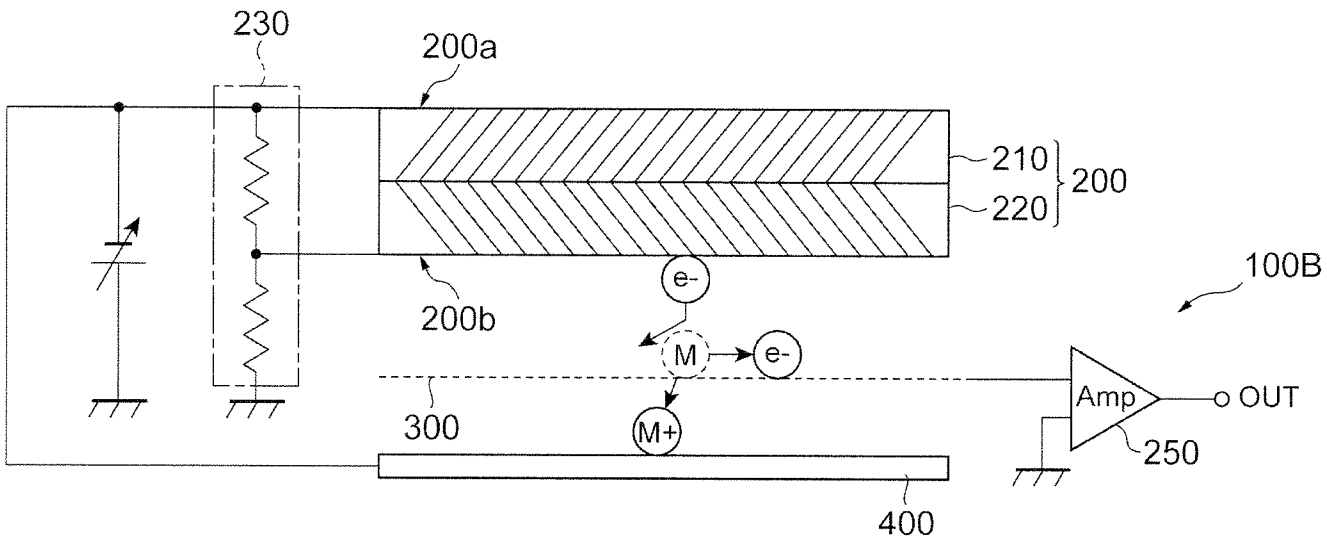
FIG. 2 is a view for describing a rough configuration of a charged-particle detector according to the present embodiment.

FIG. 2 is a view for describing a rough configuration of a charged-particle detector according to the present embodiment. Meanwhile, FIGS. 3A and 3B are views for describing a rough configuration of a MCP unit which can be applied to the charged-particle detector according to the present embodiment.

Figure 1A:
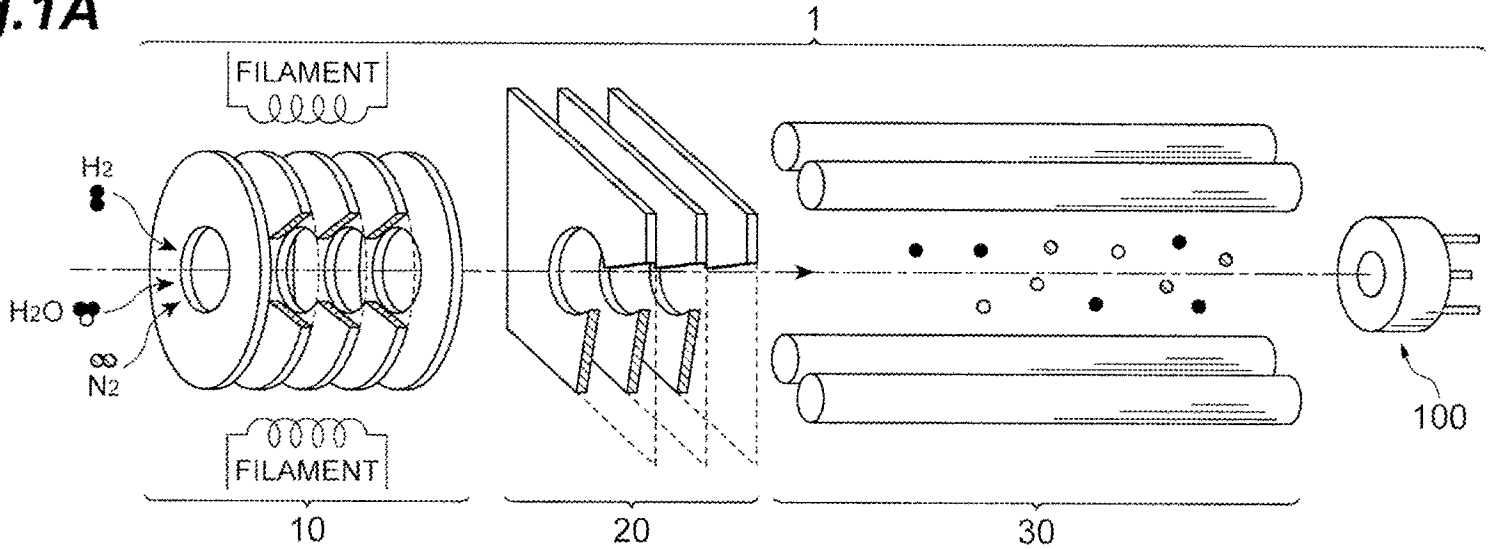
FIG. 1A is a view showing an example of a configuration of a residual gas analyzer as an example of a mass analyzer.
Figure 1B:
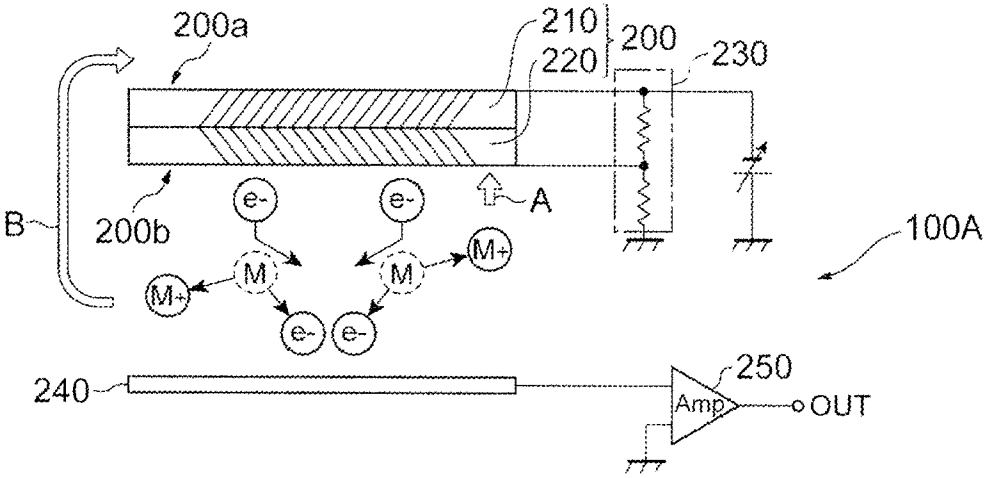
FIG. 1B is a view showing an example of the structure of a general charged-particle detector.

A charged-particle detector 100B according to the present embodiment can be applied to the measuring part 100 of the residual gas analyzer 1 shown in FIG. 1A. Specifically, as shown in FIG. 2, the charged-particle detector 100B is provided with: a MCP unit 200 having an input surface 200*a* and an output surface 200*b*; a first electrode (an electrode for capturing negatively-charged particles typified by electrons) 300 for reading the electrons, which are emitted from the output surface 200*b* of the MCP unit 200, as electric signals; and a second electrode (an electrode for capturing positively-charged particles typified by positive ions) 400 for capturing unnecessary positive ions ($M^+$) generated in the flight space of the electrons emitted from the output surface 200*b* of the MCP unit 200. Moreover, voltages (each of which is a negative voltage) having mutually different values are applied from a bleeder circuit (voltage control circuit) 230 to the input surface 200*a* and the output surface 200*b* of the MCP unit 200, respectively, so that the potential of the output surface 200*b* becomes higher than the potential of the input surface 200*a*. The first electrode 300 is set to a ground potential (0 V), and the electrons, which are captured by the first electrode 300 and from the MCP unit 200, are input to an amplifier 250 as an electric signal. Then, the electric signal (amplified signal) amplified by the amplifier 250 is detected from an output end OUT. On the other hand, the second electrode 400 is set to the same potential as that of the input surface 200*a* of the MCP unit 200 (potential lower than that of the output surface 200*b*), and the unnecessary residual-gas ions (mostly, positive ions) generated by electron ionization in the flight space of the electrons emitted from the output surface 200*b* of the MCP unit 200 are captured by the second electrode 400. Therefore, in the charged-particle detector 100B, generation of the dark noise caused by ion feedbacks can be effectively suppressed.

Figure 3A:
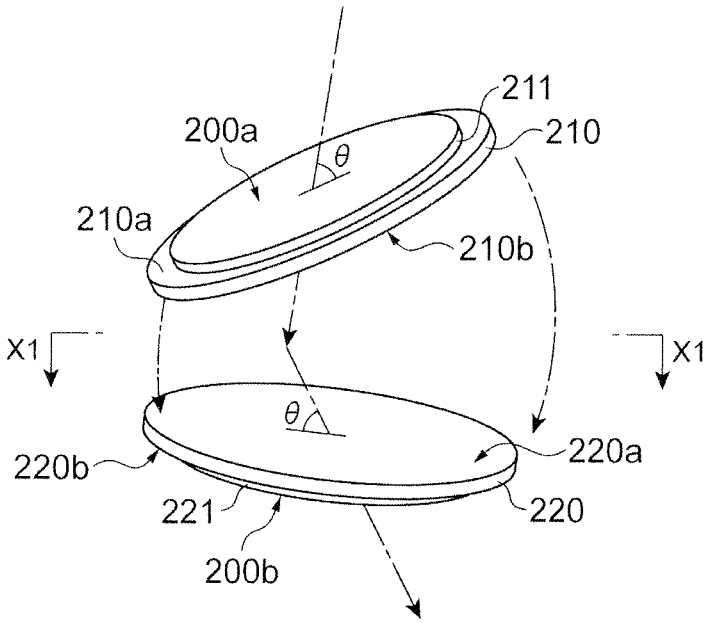
FIGS. 3A and 3B are views for describing a rough configuration of a MCP unit which can be applied to the charged-particle detector according to the present embodiment.
Figure 3B:
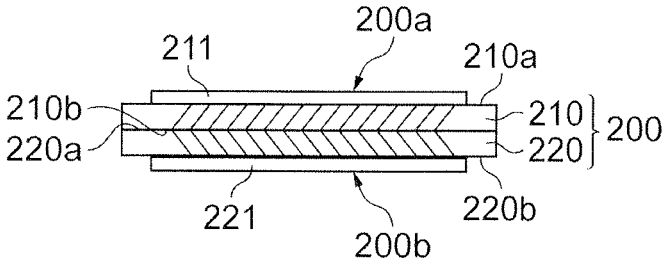

Note that an example of the structure of the MCP unit 200 applied to the charged-particle detector 100B is shown by FIGS. 3A and 3B. More specifically, FIG. 3A is a view showing an assembly process of the MCP unit 200, and FIG. 3B is a cross-sectional view of the MCP unit 200 along a line X1-X1 in FIG. 3A.

As shown in FIG. 3A, the MCP unit 200 is provided with a MCP 210, which has an input surface 210*a* and an output surface 210*b*, and a MCP 220, which has an input surface 220*a* and an output surface 220*b*. A plurality of through holes (channels having inner walls on which secondary-electron emitting surfaces are formed) formed in the MCP 210 are inclined at a predetermined bias angle θ with respect to the input surface 210*a*. Similarly, a plurality of through holes (channels having inner walls on which secondary-electron emitting surfaces are formed) formed in the MCP 220 are also inclined at the predetermined bias angle θ with respect to the input surface 220*a*. Herein, the bias angle is an inclination angle of the channels provided in order to prevent incident charged particles from passing through the MCP without colliding the inner walls of the channels.

The two MCPs 210 and 220 having the structures as described above are stacked by pasting the output surface 210*b* and the input surface 220*a* to each other so that the bias angles thereof do not match each other. Furthermore, an electrode 211 is formed on the input surface 210*a* of the MCP 210 by vapor deposition, and an electrode 221 is formed also on the output surface 220*b* of the MCP 220 by vapor deposition. Therefore, in a state in which the two MCPs 210 and 220 are pasted with each other, an exposed surface of the electrode 211 serves as the input surface 200*a* of the MCP unit 200, and an exposed surface of the electrode 221 serves as the output surface 200*b* of the MCP unit 200. Herein, the electrode 211 is formed to expose 0.5 mm to 1.0 mm from an outer peripheral end of the input surface 210*a* without covering the entire surface of the input surface 210*a* of the MCP 210. The same applies also to the electrode 221.

Figures 4A, 4B:
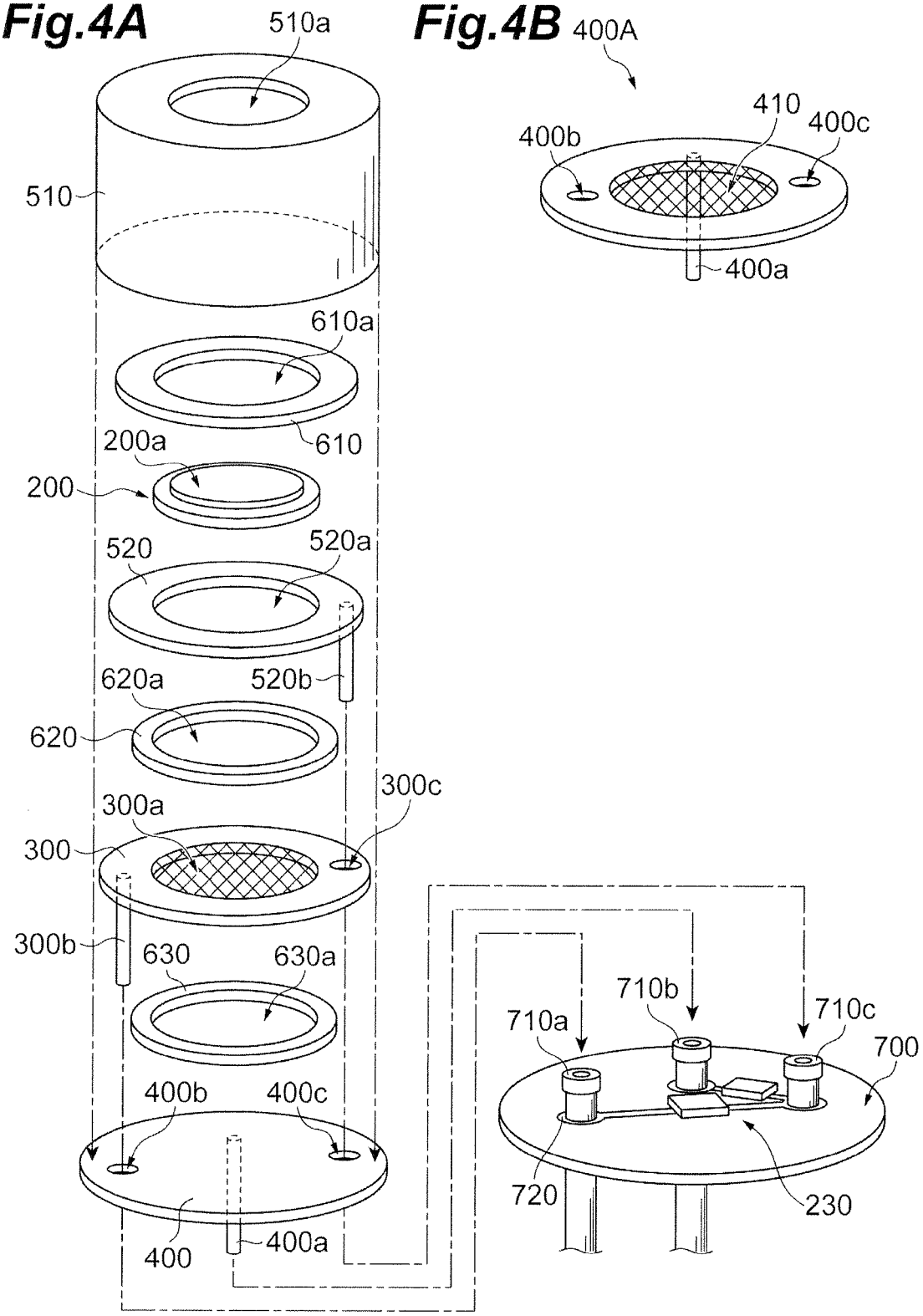
FIGS. 4A and 4B are views for describing an assembly process of a charged-particle detector according to the present embodiment.
Figure 5A:
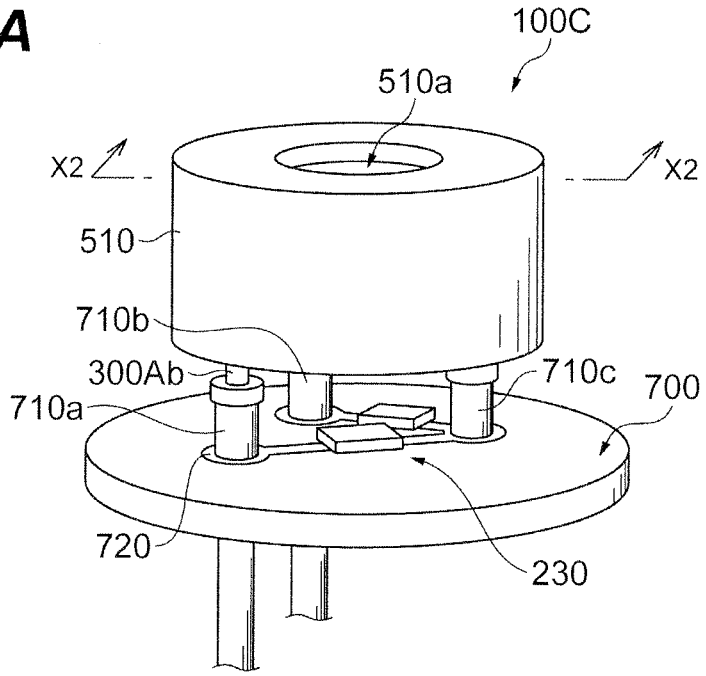
FIG. 5A is a perspective view showing the charged-particle detector obtained through the assembly process shown in FIG. 4.
Figure 5B:
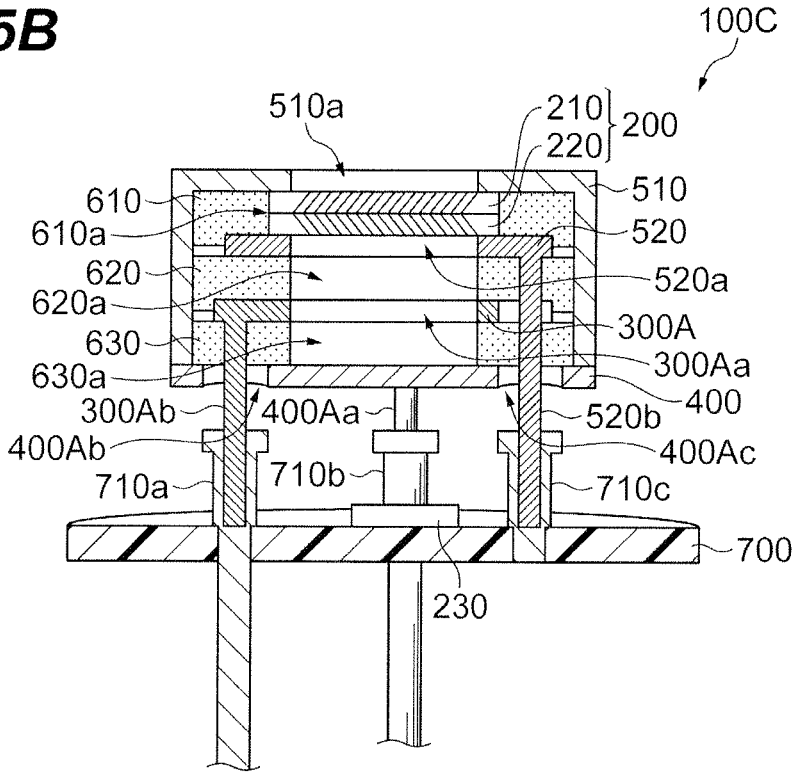
FIG. 5B is a cross-sectional view showing an internal structure of the charged-particle detector along a line X2-X2 in FIG. 5A.

Next, the structure of the charged-particle detector 100B according to the present embodiment will be described by using FIGS. 4A, 4B, 5A, and 5B. FIG. 4A is a view for describing an assembly process of a charged-particle detector according to the present embodiment. Note that FIG. 4B is a view showing another structure example of the second electrode, which replaces a second electrode 400 shown in FIG. 4A. FIG. 5A is a perspective view of the charged-particle detector 100B obtained through the assembly process shown in FIG. 4A. FIG. 5B is a cross-sectional view of the charged-particle detector 100B along a line X2-X2 in FIG. 5A.

In the assembly process of the charged-particle detector 100B, sequentially along the direction from the MCP unit 200 toward the second electrode 400 (the direction along a central axis of the MCP unit 200), an MCP input-side electrode 510 (hereinafter, described as "MCP-In electrode"); an insulating spacer 610 having a through hole 610*a*, which houses the MCP unit 200; an MCP output-side electrode 520 (hereinafter, described as "MCP-Out electrode"); an upper insulating ring 620; the first electrode 300 (electrode for capturing negatively-charged particles); a lower insulating ring 630; and the second electrode (electrode for capturing positively-charged particles) 400 are disposed. The MCP-In electrode 510 and the second electrode 400 also function as a body of the charged-particle detector 100B. Specifically, a flange portion constituting part of the MCP-In electrode 510 and the second electrode 400 are welded with each other (the MCP-In electrode 510 and the second electrode 400 are set to the same potential). In the internal space defined in this manner by the MCP-In electrode 510 and the second electrode 400, the insulating spacer 610, the MCP-Out electrode 520, the upper insulating ring 620, the first electrode 300, and the lower insulating ring 630 are housed. Furthermore, in the opposite side of the MCP unit 200 with the second electrode 400 interposed therebetween, a bleeder circuit board 700 is disposed, and the metal body part (formed by the MCP-In electrode 510 and the second electrode 400) housing the MCP unit 200 is fixed to the bleeder circuit board 700 via lead pins extending from the second electrode 400 in order to apply desired voltages to electrodes.

Specifically, the MCP unit 200 is sandwiched by the MCP-In electrode 510 and the MCP-Out electrode 520 in a state in which the MCP unit 200 is housed in the through hole 610*a* of the insulating spacer 610 having a disk shape. In this process, the MCP-In electrode 510 is electrically connected to the electrode 211 formed on the input surface 200*a* of the MCP unit 200; and, similarly, the MCP-Out electrode 520 is electrically connected to the electrode 221 formed on the output surface 200*b* of the MCP unit 200.

Note that the MCP-In electrode 510 has an opening 510*a* for exposing the input surface 200*a* of the MCP unit 200 and has the flange portion constituting part of the body, which houses other electrodes together with the MCP unit 200. The flange portion of the MCP-In electrode 510 has a shape extending from the MCP unit 200 toward the second electrode 400 in a state in which the flange portion is surrounding the other electrodes together with the MCP unit 200, and an end thereof is welded with the second electrode 400. In the above described manner, in the present embodiment, the MCP-In electrode 510 and the second electrode 400 constitute the body which houses the MCP unit 200 and the other electrodes. Meanwhile, in this configuration, since the flange portion of the MCP-In electrode 510 functions as a potential setting structure (power feeding part), the MCP-In electrode 510 and the second electrode 400 are set to the same potential. On the other hand, the MCP-Out electrode 520 has an opening 520*a* for exposing the output surface 200*b* of the MCP unit 200 and a power-feeding pin 520*b* for setting the MCP-Out electrode 520 to a predetermined potential.

The first electrode 300 is mainly an electrode for capturing negatively-charged particles (signal-reading electrode), which captures the secondary electrons emitted from the MCP unit 200 and has a disk shape provided with a through hole. At an open end of the through hole, metal mesh (wire electrode portion) 300*a* is disposed. Moreover, the first electrode 300 has a power-feeding pin 300*b* for setting the first electrode 300 to a predetermined potential and also has a communication hole 300*c* for causing the power-feeding pin 520*b* of the MCP-Out electrode 520 to penetrate therethrough without contact. The first electrode 300 having such a structure is sandwiched by the upper insulating ring 620, which is provided with an opening 620*a* for exposing the metal mesh 300*a* disposed so as to block the open end of the through hole, and the lower insulating ring 630, which is provided with an opening 630*a* for exposing the metal mesh 300*a*. Note that the upper insulating ring 620 functions as an insulating spacer for electrically separating the MCP-Out electrode 520 and the first electrode 300 from each other, and the lower insulating ring 630 functions as an insulating spacer for electrically separating the first electrode 300 and the second electrode 400 from each other.

The second electrode 400 is the positively-charged-particle capturing electrode for capturing the unnecessary residual-gas ions (W) generated by electron ionization in the flight space of the secondary electrons emitted from the MCP unit 200. In the electrode space in which a triode structure is formed at least by the MCP-Out electrode 520, the first electrode 300, and the second electrode 400, the second electrode 400 is set to a lowest potential. Therefore, the unnecessary positively-charged particles generated in this electrode space naturally move toward the second electrode 400. Therefore, by virtue of the presence of the second electrode 400, the phenomenon in which the generated residual-gas ions move toward the MCP unit 200 side, in other words, generation of ion feedbacks can be effectively suppressed. Specifically, the second electrode 400 is provided with a power-feeding pin 400*a* to which a predetermined voltage is applied so as to set the potential lower than the potential of the MCP-Out electrode 520. Furthermore, the second electrode 400 is provided with a communication hole 400*b* for causing the power-feeding pin 300*b* of the first electrode 300 to penetrate therethrough without contact and a communication hole 400*c* for causing the power-feeding pin 520*b* of the MCP-Out electrode 520 to penetrate therethrough without contact. Since the outer peripheral end of the second electrode 400 is electrically connected to the flange portion of the MCP-In electrode 510, when a predetermined voltage is applied to the second electrode 400 via the power-feeding pin 400*a*, the MCP-In electrode 510 and the second electrode 400 are set to the same potential. Note that the potential of the second electrode 400 may be set to be higher or lower than the potential of the MCP-In electrode 510 as long as the potential of the second electrode 400 is lower than the potential of the MCP-Out electrode 520.

Note that, in the present embodiment, instead of the above described second electrode 400, a second electrode 400A having the structure shown in FIG. 4B may be applied. As well as the second electrode 400 of FIG. 4A, the second electrode 400A of FIG. 4B is provided with the power-feeding pin 400*a*, the communication hole 400*b*, and the communication hole 400*c*. Furthermore, the second electrode 400A has a through hole at the center thereof and has a mesh-shaped or lattice-shaped wire electrode portion disposed so as to block an open end of the through hole. By virtue of this configuration, it is enabled to cause the pressure in a vacuum chamber in which the charged-particle detector 100B is installed and the pressure in the detector body to match each other.

The bleeder circuit board 700 is a glass epoxy board having a disk shape, functions as a supporting part of the detector body formed in the above described manner, and is equipped with the bleeder circuit (voltage-dividing circuit) 230 for supplying desired voltages to the electrodes. Specifically, the bleeder circuit board 700 retains: a metal socket 710*a* in which the power-feeding pin 300*b* of the first electrode 300 is inserted; a metal socket 710*b* in which the power-feeding pin 400*a* of the second electrode 400 electrically connected to the MCP-In electrode 510 is inserted; and a metal socket 710*c* in which the power-feeding pin 520*b* of the MCP-Out electrode 520 is inserted. Moreover, these metal sockets 710*a* to 710*c* are electrically connected to the bleeder circuit 230 by printed wiring 720 formed on a surface of the bleeder circuit board 700. Note that as long as the power-feeding pins 300*b*, 400*a*, and 520*b* of the electrodes and the bleeder circuit 230 are structured to be electrically connected via the printed wiring 720, the sockets 710*a* to 710*c* may be formed of materials other than metal.

Figure 6A:
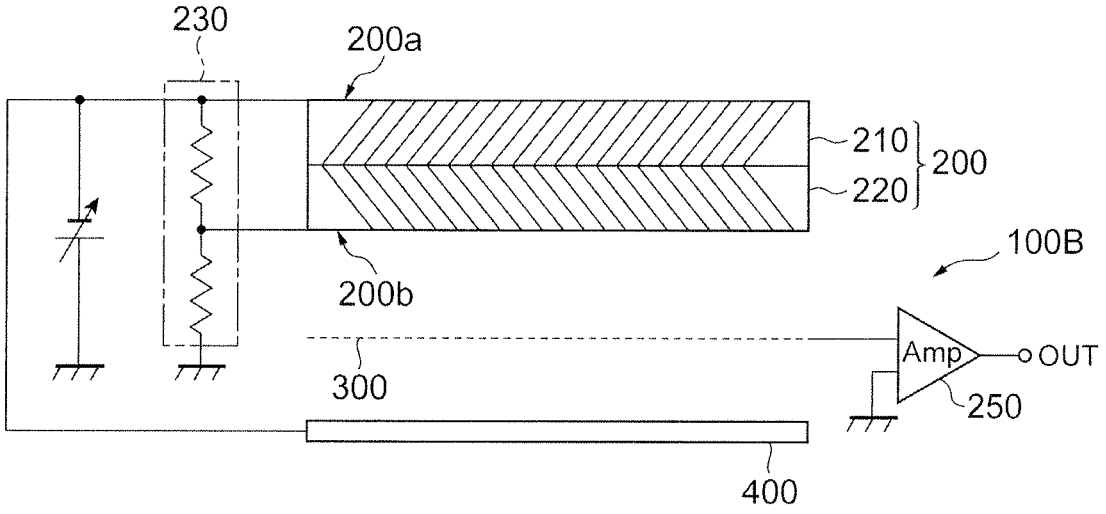
FIG. 6A is a view showing a typical configuration of the charged-particle detector according to the present embodiment.
Figure 6B:
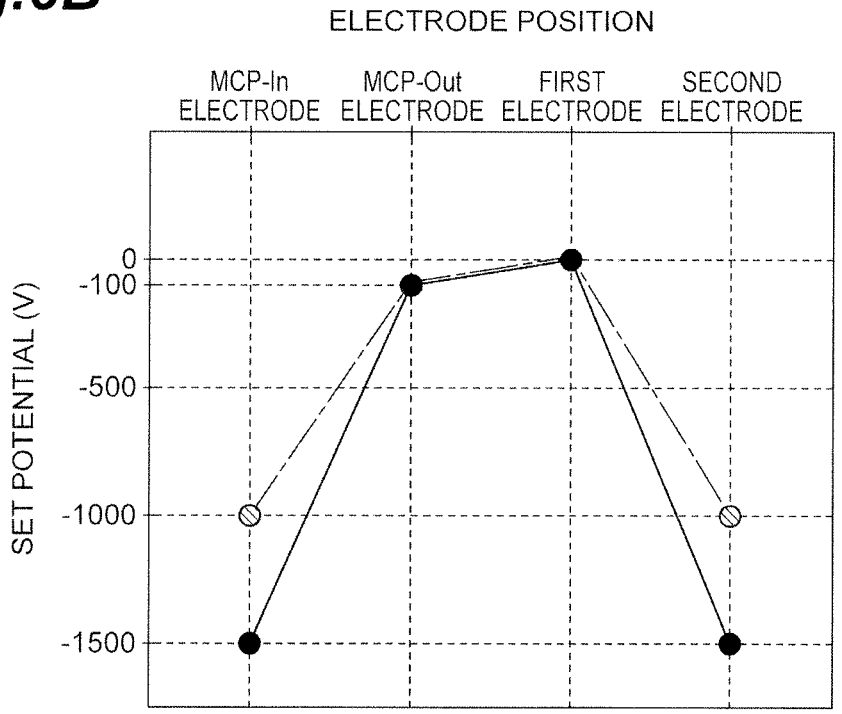
FIG. 6B is a diagram showing potential gradients of the charged-particle detector set by a controlling method according to the present embodiment.
Figure 7A:
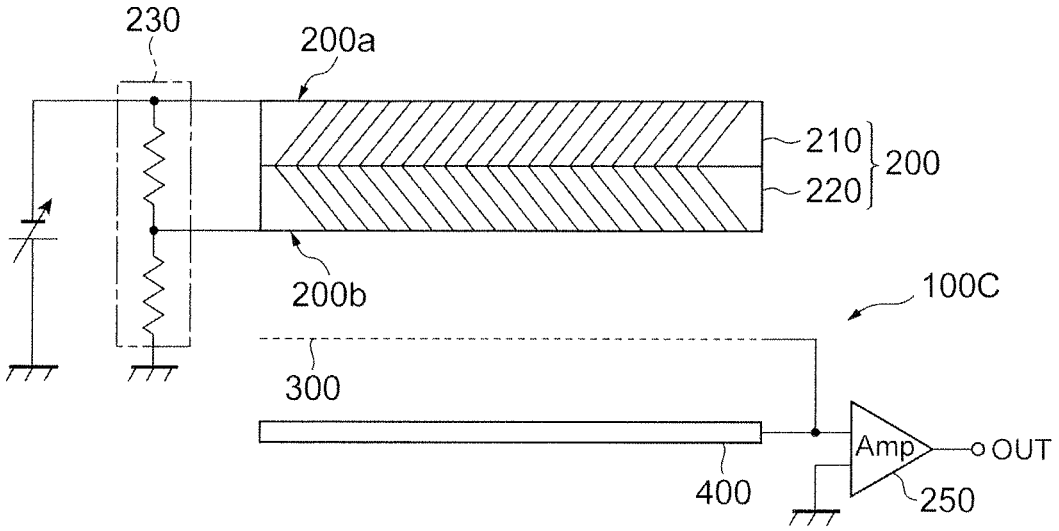
FIG. 7A is a view showing a configuration of a charged-particle detector according to a comparative example.
Figure 7B:
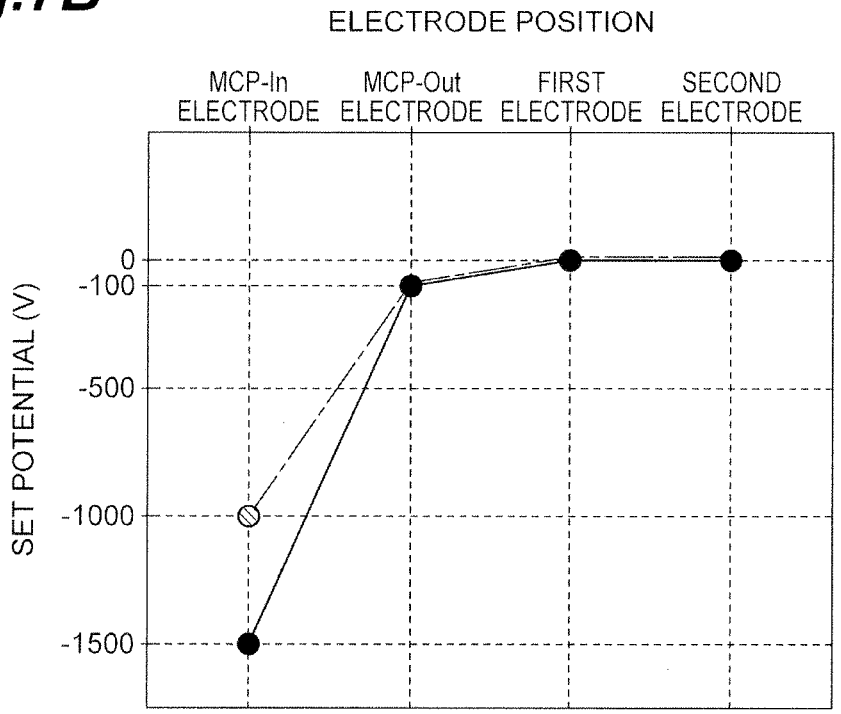
FIG. 7B is a diagram showing potential gradients of the charged-particle detector according to the comparative example.
Figure 8A:
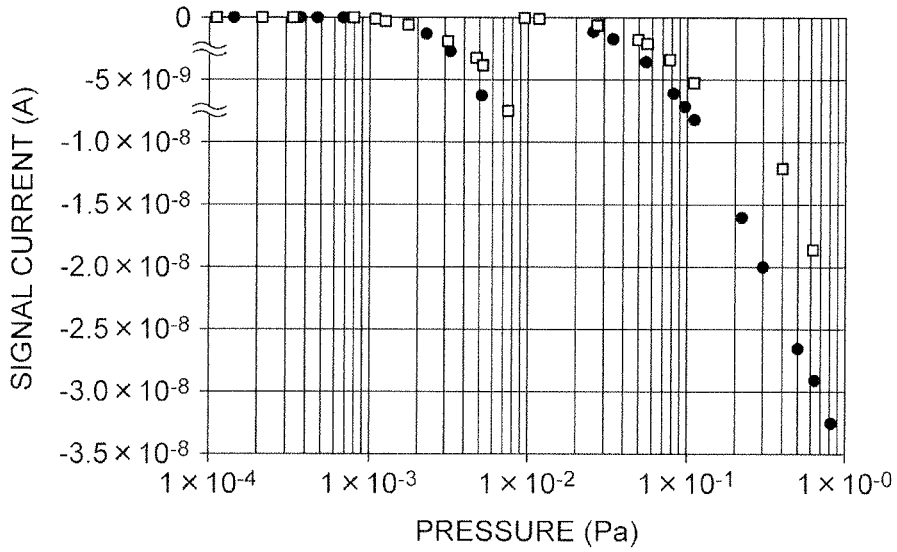
FIGS. 8A and 8B are graphs showing comparison results of the effects of suppressing ion feedbacks about the residual gas analyzer 1 to which the charged-particle detector 100B shown in FIGS. 6A and 6B is applied and the residual gas analyzer 1 to which the charged-particle detector 100C shown in FIGS. 7A and 7B is applied.
Figure 8B:
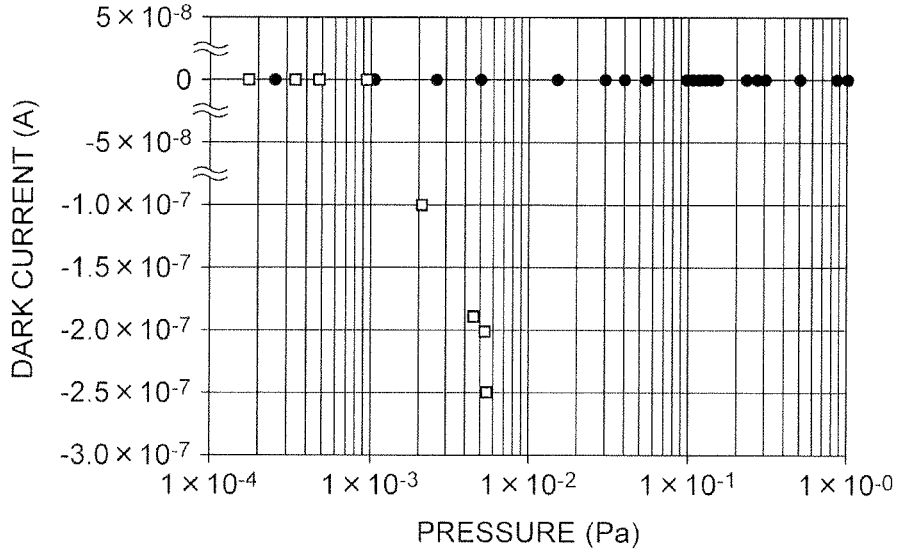

Next, characteristic evaluations of the charged-particle detector 100B assembled in the above described manner will be described by using FIGS. 6A to 8B together with a controlling method according to the present embodiment. Note that FIG. 6A is a view showing a configuration of the charged-particle detector 100B according to the present embodiment; and FIG. 6B is a diagram showing the potential gradients set by the controlling method according to the present embodiment, in other words, the potential gradients of the charged-particle detector 100B in a low-gain ($10^3$) mode and a high-gain ($10^5$) mode. FIG. 7A is a view showing a configuration of a charged-particle detector 100C according to a comparative example; and FIG. 7B is a diagram showing potential gradients of the charged-particle detector 100C in a low-gain ($10^3$) mode and a high-gain ($10^5$) mode. Meanwhile, FIGS. 8A and 8B are graphs showing comparison results of the effects of suppressing ion feedbacks about the residual gas analyzer 1 (FIG. 1A) to which the charged-particle detectors 100B and 100C prepared for characteristic evaluations are separately applied. Particularly, FIG. 8A is a graph showing the relations between signal currents detected via the first electrode 300 (electrons captured by the first electrode 300) and the pressure in the detector in the low-gain ($10^3$) mode; and FIG. 8B is a graph showing the relations between dark currents detected via the first electrode 300 (dark noise caused by ion feedbacks of residual-gas ions) in the high-gain ($10^5$) mode and the pressure in the detector. Note that the reason why the dark-current detection (FIG. 8B) is carried out in the high-gain mode is that the influence of ion feedbacks can be checked in more detail in the detection in the high-gain mode more than the detection in the low-gain mode.

The structure of the prepared charged-particle detector 100B according to the present embodiment is the same as the structure shown in FIG. 2. More specifically, as shown in FIG. 6A, the charged-particle detector 100B is provided with: the MCP unit 200 having the input surface 200*a* and the output surface 200*b*; the first electrode 300 as an electrode for capturing negatively-charged particles; and the second electrode 400 as an electrode for capturing positively-charged particles. Moreover, voltages having mutually different values are applied from the bleeder circuit 230 to the input surface 200*a* and the output surface 200*b* of the MCP unit 200, respectively, so that the potential of the output surface 200*b* becomes higher than the potential of the input surface 200*a*. The first electrode 300 is set to the ground potential (0 V), and the electrons, which are captured by the first electrode 300 and from the MCP unit 200, are input to the amplifier 250 as an electric signal. Then, the electric signal (amplified signal) amplified by the amplifier 250 is detected from the output end OUT. On the other hand, the second electrode 400 is set to the same potential as the input surface 200*a* of the MCP unit 200 (potential lower than that of the output surface 200*b*).

The specific potential gradients of the charged-particle detector 100B are set as shown in FIG. 6B. More specifically, in a detection operation in the low-gain ($10^3$) mode, the MCP-In electrode 510 and the second electrode 400 are set to −1000 V, the MCP-Out electrode 520 is set to −100 V, and the first electrode 300 is set to the ground potential (0 V). On the other hand, in a detection operation in the high-gain ($10^5$) mode, the MCP-In electrode 510 and the second electrode 400 are set to −1500 V, the MCP-Out electrode 520 is set to −100 V, and the first electrode 300 is set to the ground potential (0 V).

FIG. 7A shows the structure of the prepared charged-particle detector 100C according to the comparative example. More specifically, as shown in FIG. 7A, the charged-particle detector 100C according to the comparative example is provided with: the MCP unit 200 having the input surface 200*a* and the output surface 200*b*; the first electrode 300 as an electrode for capturing negatively-charged particles; and the second electrode 400 as an electrode for capturing positively-charged particles. Moreover, voltages having mutually different values are applied from the bleeder circuit 230 to the input surface 200*a* and the output surface 200*b* of the MCP unit 200, respectively, so that the potential of the output surface 200*b* becomes higher than the potential of the input surface 200*a*. On the other hand, both of the first electrode 300 and the second electrode 400 are set to the ground potential (0 V), and the electrons, which are captured by both of the first electrode 300 and the second electrode 400 and from the MCP unit 200, are input to the amplifier 250 as an electric signal. Then, the electric signal (amplified signal) amplified by the amplifier 250 is detected from an output end OUT.

The specific potential gradients of the charged-particle detector 100C according to the comparative example formed in this manner are set as shown in FIG. 7B. More specifically, in a detection operation in the low-gain ($10^3$) mode, the MCP-In electrode 510 is set to −1000 V, the MCP-Out electrode 520 is set to −100 V, and both of the first electrode 300 and the second electrode 400 are set to the ground potential (0 V). On the other hand, in a detection operation in the high-gain ($10^5$) mode, the MCP-In electrode 510 is set to −1500 V, the MCP-Out electrode 520 is set to −100 V, and both of the first electrode 300 and the second electrode 400 are set to the ground potential (0 V).

FIG. 8A is the graph showing the relations between the signal currents detected via the first electrode 300 (electrons captured by the first electrode 300) in a detection operation in the low-gain ($10^3$) mode; and FIG. 8B is the graph showing the relations between the dark currents detected via the first electrode 300 (dark noise caused by ion feedbacks of residual-gas ions) in the high-gain ($10^5$) mode and the pressure in the detector.

In FIGS. 8A and 8B, symbols "●" represent the detection results of the signal currents in the residual gas analyzer 1 to which the charged-particle detector 100B according to the present embodiment is applied, and symbols "□" represent the detection results of the dark currents in the residual gas analyzer 1 to which the charged-particle detector 100C according to the comparative example is applied. Note that, as a premise, the lower the vacuum degree, the higher the number of residual gas molecules, and, therefore, the number of ions generated by the ion source 10 of the residual gas analyzer 1 is also significantly increased.

As shown in FIG. 8A, in the ion detection in the low-gain mode, in both of the charged-particle detector 100B according to the present embodiment and the charged-particle detector 100C according to the comparative example, the number of detected electrons (output of signal currents) is significantly increased as the vacuum degree is reduced (the ions generated by the ion source 10 are increased). However, when the detection results of the signal currents of the charged-particle detector 100B according to the present embodiment and the detection results of the signal currents of the charged-particle detector 100C according to the comparative example are compared with each other, it is obvious that the detection sensitivity is significantly improved in the charged-particle detector 100B according to the present embodiment. Note that a discontinuity at a vacuum degree $10^{-2}$ Pa in FIG. 8A is generated since filament-temperature switching is carried out in order to once suppress the number of ions generated by the ion source 10.

On the other hand, as shown in FIG. 8B, in the residual gas analyzer 1 to which the charged-particle detector 100B according to the present embodiment is applied, it was confirmed that dark currents were not detected almost at all (generation of ion feedbacks was effectively suppressed) even when the vacuum degree was reduced (the ions generated by the ion source 10 were increased) in the ion detection in the high-gain mode. On the other hand, in the residual gas analyzer 1 to which the charged-particle detector 100C according to the comparative example is applied, it was confirmed that the dark currents were significantly increased as the vacuum degree was reduced in the ion detection in the high-gain mode. In other words, in the charged-particle detector 100C according to the comparative example, the effects of suppressing ion feedbacks are not obtained.

In the controlling method according to the present embodiment, in the inter-electrode space in which the triode structure is formed at least by the MCP-Out electrode 520, the first electrode 300, and the second electrode 400, as described above, the first electrode 300, which is the electrode for capturing negatively-charged particles, is set to the highest potential, and the second electrode 400, which is the electrode for capturing positively-charged particles, is set to the lowest potential. In the electrode space like this, mainly the negatively-charged particles such as electrons emitted from the MCP unit move toward the electrode set to the highest potential, and, on the other hand, the positively-charged particles such as unnecessary residual-gas ions generated by electron ionization between the electrodes move toward the electrode set to the lowest potential. Therefore, according to the controlling method according to the present embodiment, the electrons captured as signals and the unnecessary residual-gas ions can be separated from each other, and the unnecessary residual-gas ions (positive ions), which are causes of ion feedbacks, can be captured.

As described above, according to the present embodiment, the unnecessary residual-gas ions (positively-charged particles) generated by collisions between the electrons from the MCP unit and the residual-gas molecules between the electrodes under a low-vacuum-degree environment can be efficiently separated from the electrons (negatively-charged particles), which are to be captured as signals, and can be captured. As a result, the ion feedbacks from the electron flight space positioned between the electrodes (the inter-electrode space in which the triode structure is formed by at least the MCP-Out electrode 520, the first electrode 300, and the second electrode 400) to the MCP unit can be effectively suppressed.

According to the above description of the present invention, it is obvious that the present invention can be variously modified. Such modifications are not recognized to deviate from the ideas and scope of the present invention, and the improvements obvious to all of those skilled in the art are included in the following claims.

What is claimed is:

1. A charged-particle detector comprising:

a MCP unit having an input surface and an output surface opposed to the input surface and including one or more microchannel plate(s) disposed in space between the input surface and the output surface;

a MCP input-side electrode disposed in a state in which at least part of the MCP input-side electrode contacts the input surface of the MCP unit, the MCP input-side electrode having an opening for exposing the input surface of the MCP unit;

a MCP output-side electrode disposed in a state in which at least part of the MCP output-side electrode contacts the output surface of the MCP unit, the MCP output-side electrode having an opening for exposing the output surface of the MCP unit, the MCP output-side electrode configured to be set to a potential higher than that of the MCP input-side electrode;

a signal-reading electrode disposed so as to sandwich the MCP output-side electrode together with the MCP input-side electrode, the signal-reading electrode having one or more openings, the signal-reading electrode configured so as to be set to a potential higher than that of the MCP output-side electrode to capture negatively-charged particles; and an ion capturing electrode disposed so as to sandwich the signal-reading electrode together with the MCP output-side electrode, the ion capturing electrode configured so as to be set to a potential lower than that of the MCP output-side electrode to capture positively-charged particles whereby secondary electrons from the output surface of the MCP unit move toward the signal-reading electrode and are directly captured as signals by the signal-reading electrode without reaching the ion capturing electrode.

2. The charged-particle detector according to claim 1, wherein the signal-reading electrode has:

a first principal surface facing the MCP output-side electrode;

a second principal surface facing the ion capturing electrode;

a through hole communicating the first principal surface and the second principal surface to each other; and a mesh-shaped or lattice-shaped wire electrode portion disposed so as to block an opening of the through hole, and the wire electrode portion defining the plurality of openings.

3. The charged-particle detector according to claim 1, further comprising a potential setting structure for electrically connecting the ion capturing electrode and the MCP input-side electrode to each other.

4. The charged-particle detector according to claim 3, wherein the MCP input-side electrode has, as the potential setting structure, a shape extending from the MCP input-side electrode toward the ion capturing electrode in a state in which the MCP unit, the MCP output-side electrode, and the signal reading electrode are surrounded, and the MCP input-side electrode has a flange portion directly in contact with the ion capturing electrode.

5. The charged-particle detector according to claim 1, further comprising a voltage control circuit for applying mutually different voltages respectively to the signal-reading electrode and the ion capturing electrode so that potentials of the signal-reading electrode and the ion capturing electrode are different from each other.

6. A method of controlling the charged-particle detector according to claim 1, wherein a voltage higher than a voltage applied to the MCP output-side electrode is applied to the signal-reading electrode, while a voltage lower than the voltage applied to the MCP output-side electrode is applied to the ion capturing electrode so as to form a potential gradient in which the signal-reading electrode is positioned at a peak in space defined between the MCP output-side electrode and the ion capturing electrode.

7. The controlling method according to claim 6, wherein the MCP input-side electrode and the ion capturing electrode are set to the same potential by applying equal voltages to the MCP input-side electrode and the ion capturing electrode.

* * * * *